US006432257B1

(12) United States Patent
Nagasaka et al.

(10) Patent No.: US 6,432,257 B1
(45) **Date of Patent: *Aug. 13, 2002**

(54) DRESSER FOR POLISHING CLOTH AND METHOD FOR MANUFACTURING SUCH DRESSER AND POLISHING APPARATUS

(75) Inventors: Hiroshi Nagasaka; Momoko Kakutani; Kunio Tateishi, all of Kanagawa-ken; Naoaki Ogure; Takashi Yoda, both of Tokyo, all of (JP)

(73) Assignee: Ebara Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/018,909

(22) Filed: Feb. 5, 1998

(30) Foreign Application Priority Data

Feb. 7, 1997 (JP) ..... 9-039870

(51) Int. Cl.[7] ..... B24B 5/00; B24B 29/00

(52) U.S. Cl. ..... 156/345.12; 216/88; 451/56

(58) Field of Search ..... 156/345; 216/88–90; 427/530, 419.7, 577; 438/691–693; 451/56, 285–287

(56) References Cited

U.S. PATENT DOCUMENTS 4,415,421 A * 11/1983 Sasanuma ..... 204/192 N
5,216,843 A * 6/1993 Breivogel et al. ..... 451/285
5,462,775 A * 10/1995 Yamada et al. ..... 427/573
5,527,424 A * 6/1996 Mullins ..... 438/692
5,536,202 A * 7/1996 Appel et al. ..... 451/285
5,611,943 A * 3/1997 Cadien et al. ..... 216/88
5,626,509 A 5/1997 Hayashi ..... 451/285
5,665,201 A * 9/1997 Sahota ..... 438/693
5,851,138 A * 12/1998 Hempel, Jr. ..... 451/56

OTHER PUBLICATIONS

Pending U.S. patent application Ser. No. 08/734,197, filed Oct. 21, 1996, to Norio Kimura et al., entitled "Method and Apparatus for Dressing Polishing Cloth".

* cited by examiner

*Primary Examiner*—Gregory Mills
*Assistant Examiner*—Sylvia R. MacArthur
(74) *Attorney, Agent, or Firm*—Wenderoth, Lind & Ponack, L.L.P.

(57) ABSTRACT

A improved dresser for dressing a polishing surface, easily be manufactured such that an object to be polished is not scratched when the object is polished. The dresser can dress the polishing surface of a polishing apparatus to effect surface correction and to correct a time-lapse change due to a polishing operation, a number of spired projections are formed on a surface of a metallic substrate and a wear-resistant hard film is formed on at least a portion of the surface of the metallic substrate on which the projections are formed.

26 Claims, 5 Drawing Sheets

DRESSER FOR POLISHING CLOTH AND METHOD FOR MANUFACTURING SUCH DRESSER AND POLISHING APPARATUS

BACKGROUND OF THE INVENTION

The present invention relates to an improved dresser for correcting a time-lapse change (due to a polishing operation) of a polishing surface of a polishing apparatus used to polish a surface of a work object to be polished, such as a semiconductor wafer, a method for manufacturing such a dresser, and a polishing apparatus and method utilizing such an improved dresser.

In a polishing apparatus used to polish a surface of an object (referred to as "work object" hereinafter) such as a semiconductor wafer, a polishing cloth which provides a polishing surface is adhered to an upper surface of a turntable, and, the work object mounted on a top ring is urged against the polishing surface, that is, an upper surface of the polishing cloth, and, the surface of the work object is polished by relative movement between the polishing surface and the work object while supplying an abrasive liquid (slurry) to the polishing surface of the polishing cloth.

In such a polishing apparatus, as the polishing operation is continued for a long time, abrasive particles of the abrasive liquid and polished waste matter from the work object adhere or stick in the polishing surface, with the result that the polishing surface of the polishing cloth changes over time. Thus, after the polishing operation is continued for a predetermined time period, the polishing surface of the polishing cloth must be dressed by using a dresser to effect surface correction and to correct the time-lapse change of the polishing surface. In the past, as such a dresser, a sintered ceramic dresser using a sintered ceramic material or an electr plated dresser in which diamond particles are electro-deposited on a surface of the dresser has been used.

Regarding the above-mentioned conventional dressers, since the sintered ceramic dresser using the sintered ceramic material such as SiC, Si3N4 or Al2O3 is very fragile and brittle, it is difficult to manufacture the sintered ceramic dresser and the manufacturing cost thereof becomes expensive.

On the other hand, in the electro-plated dresser, as shown in FIG. 5, diamond particles are dispersed and electro-plated on a surface of a ring-shaped metallic substrate 100 by wet electro deposition so that, as shown in FIG. 6, the diamond particles 102 of several tens or hundreds of $\mu$m are embedded into a plated layer 101.

In the electro plated dresser, the diamond particles sometimes drop from the plated layer during the dressing operation, with the result that the polished surface of the work object such as a semiconductor wafer is scratched by the diamond particles.

Particularly, in a dresser for dressing a polishing surface of a polishing apparatus used to polish a device pattern formed on the semiconductor wafer to flatten the latter, the diamond particles dropped during the dressing operation penetrate into the polishing surface, with the result that the polished surface of the semiconductor wafer becomes deeply scratched.

SUMMARY OF THE INVENTION

In view of the above-mentioned situations, the present invention has been made. An object of the present invention is to provide an improved dresser for a polishing surface, which can eliminate the above-mentioned conventional drawbacks and can be easily manufactured and in which a polished surface of a work object such as a semiconductor wafer is not scratched, a method for manufacturing such a dresser, and a polishing apparatus utilizing such an improved dresser.

To achieve the above object, according to one aspect of the present invention, there is provided a dresser for dressing a polishing cloth such as non-woven fabric to effect surface correction and to correct changes by dressing a polishing surface of a polishing cloth (non-woven fabric) of a polishing apparatus, wherein a number of spired projections are formed on a surface of a metallic substrate and at least a portion of the surface of the metallic substrate on which the projections are formed is covered by a wear-resistant hard film.

According to another aspect of the present invention, the dresser for the polishing surface may be constituted so that (a) the wear-resistant hard film is formed from one of a transition metal group nitride film, a nitride group ceramic film, a carbide group ceramic film, an oxide group ceramic film, a diamond-like carbon film, a composite ceramic film, a nitride film and a carbide film, and (b) the transition metal group nitride film or the nitride film is made of titanium nitride.

The present invention further provides a polishing apparatus comprising a polishing cloth adhered to an upper surface of a turntable, a top ring capable of urging an object to be polished (work object) against a polishing surface of the polishing cloth, an abrasive liquid supplying nozzle for supplying abrasive liquid to the polishing surface, and an improved dresser. The polishing apparatus according to the present invention includes a dressing mechanism for dressing the polishing surface of the polishing cloth. The dressing mechanism includes a dressing member capable of urging a surface of the dresser against the polishing surface and a water supplying nozzle capable of supplying water to the polishing surface. The surface of the dresser is obtained by covering a surface of a metallic substrate on which a number of projections are formed by a wear-resistant hard film. The wear-resistant hard film is formed from one of a transition metal group nitride film, a nitride group ceramic film, a carbide group ceramic film, an oxide group ceramic film, a diamond-like carbon film, a composite ceramic film, a nitride film and a carbide film; and the transition metal group nitride film or the nitride film is made of titanium nitride.

The present invention further provides a method for manufacturing a dresser for dressing a polishing surface to effect surface correction and to correct time-lapse change of the cloth by dressing a polishing surface of the polishing cloth of a polishing apparatus, in which, after a number of spired projections are formed on a surface of a metallic substrate by a machining technique, a wear-resistant hard film is formed on at least a portion of the surface of the metallic substrate on which the projections are formed.

The method for manufacturing the dresser for the polishing surface according to the present invention may be designed so that (c) the wear-resistant hard film is formed from a ceramic film and the ceramic film is formed by chemical deposition, physical deposition, spraying, wet plating or melting plating, (d) the physical deposition is effected by a film-forming method utilizing spattering, ion plating, ion injection or ion beam, (e) the wear-resistant hard film is formed from a titanium nitride film and the titanium nitride film is formed by chemical deposition, physical deposition, spraying or wet plating, (f) the wear-resistant hard film is formed from a titanium nitride film and the titanium nitride film is formed by a dynamic mixing method in which titanium (as transition metal) is vacuum-deposited and at the same time ion beams (mainly including nitrogen ions) are irradiated, (g) the wear-resistant hard film is formed from a diamond-like carbon film and the diamond-like carbon film is formed by chemical deposition, physical deposition, spraying, wet plating or melting plating, or (h) the wear-resistant hard film is formed from a diamond-like carbon film and the diamond-like carbon film is formed by a dynamic mixing method in which carbon is deposited and at the same time ion beams (mainly including nitrogen ions) are irradiated.

DETAILED DESCRIPTION OF THE PREFERRED EMBODIMENTS

The present invention will now be explained in connection with embodiments thereof with reference to the accompanying drawings.

Figure 1:
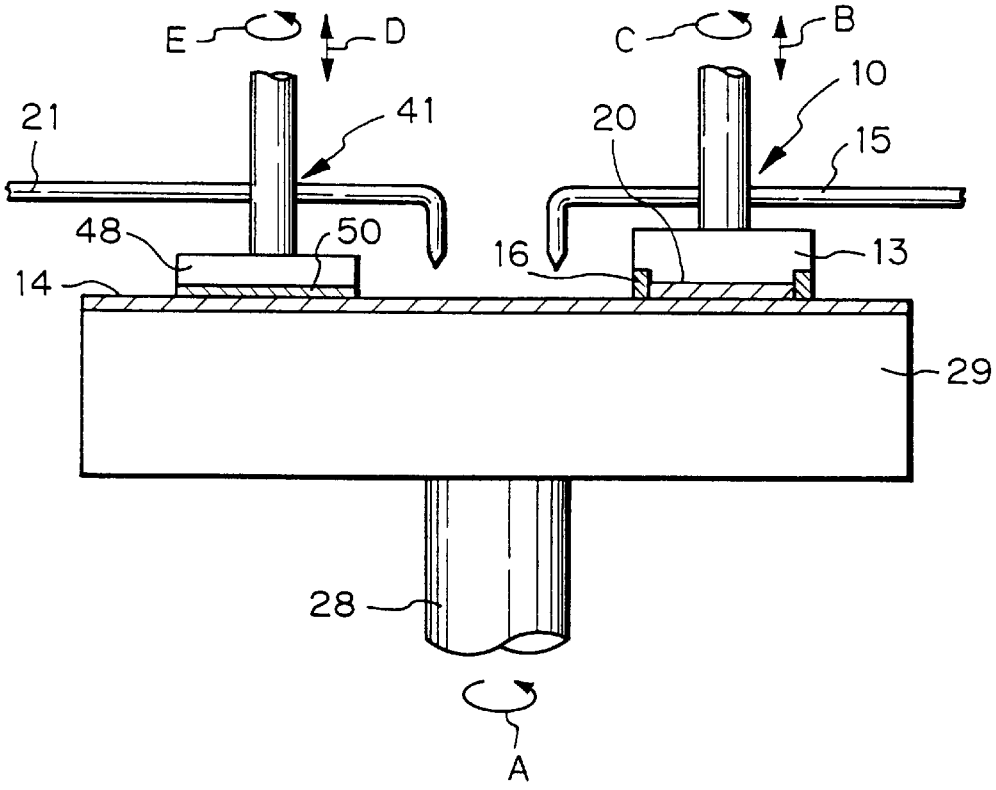
FIG. 1 is a schematic sectional view of a polishing apparatus according to a preferred embodiment of the present invention.

FIG. 1 is a schematic sectional view of a polishing apparatus according to a preferred embodiment of the present invention.

As shown in FIG. 1, a top ring head 10 is disposed above a turntable 29 and includes a top ring 13 for urging a semiconductor wafer 20 against the turntable 29 while holding the semiconductor wafer. The turntable 29 is connected to a motor (not shown) to be rotated around an axis 28 in a direction shown by the arrow A. A polishing cloth 14 which provides a polishing surface is adhered to an upper surface of the turntable 29.

The top ring 13 is connected to a motor and a lift/lower cylinder (not shown). With this arrangement, the top ring 13 can be lifted and lowered as shown by the arrow B and may be rotated around its axis as shown by the arrow C so that the semiconductor wafer 20 can be urged against the polishing cloth 14 with any pressure. The semiconductor wafer 20 can be absorbed to a lower surface of the top ring 13 by vacuum or the like. A guide ring 16 is attached to a lower peripheral portion of the top ring 13 to prevent disengagement of the semiconductor wafer 20 from the top ring.

An abrasive liquid supplying nozzle 15 is disposed above the turntable 29 so that polishing abrasive liquid can be supplied from the abrasive liquid supplying nozzle 15 to the polishing cloth 14 adhered to the turntable 29.

A dressing head 41 has a dressing member 48. The dressing member 48 is diametrically opposed to the top ring 13 above the polishing cloth 14 so that dressing of the polishing cloth 14 can be effected. A dressing liquid supplying nozzle 21 can supply dressing liquid (for example, water) to the polishing cloth 14 on the turntable 29 for a dressing operation. The dressing member 48 is connected to a lift/lower cylinder and a rotating motor so that the dressing member can be lifted and lowered as shown by the arrow D and can be rotated around its axis as shown by the arrow E.

The dressing member 48 is constituted by a disc having a diameter substantially the same as that of the top ring 13 and is provided at its lower surface with a dresser (dressing tool) 50. The abrasive liquid supplying nozzle 15 and the dressing liquid supplying nozzle 21 extend up to the vicinity of a rotational center of the turntable to supply the abrasive liquid and the dressing liquid to predetermined positions on the polishing cloth 14, respectively.

By urging the semiconductor wafer 20 held by the top ring 13 against the polishing cloth 14 and by rotating the turntable 29 and the top ring 13, the lower surface (to be polished) of the semiconductor wafer 20 is rubbed against the polishing cloth 14. At the same time, by supplying the abrasive liquid onto the polishing cloth 14 from the abrasive liquid supplying nozzle 15, the polished surface of the semiconductor wafer 20 is polished by the combination of the mechanical polishing action of the abrasive particles in the abrasive liquid and the chemical polishing action of alkali (liquid component) in the abrasive liquid.

When the semiconductor wafer 20 is polished by a predetermined amount, the polishing operation is finished. At this point, since features of the polishing cloth are caused to vary by the polishing action, thereby worsening the polishing ability of the polishing cloth, the dressing of the polishing cloth is effected.

That is to say, in a condition that the dressing member 48 holding the dresser 50 and the turntable 29 are rotated, the dresser 50 is urged against the polishing cloth 14 with predetermined pressure. In this case, the water is supplied onto the polishing cloth 14 from the dressing liquid supplying nozzle 21. By supplying the water, the waste abrasive liquid remaining on the polishing cloth 14 is washed out, thereby refreshing the polishing cloth.

Figure 2A:
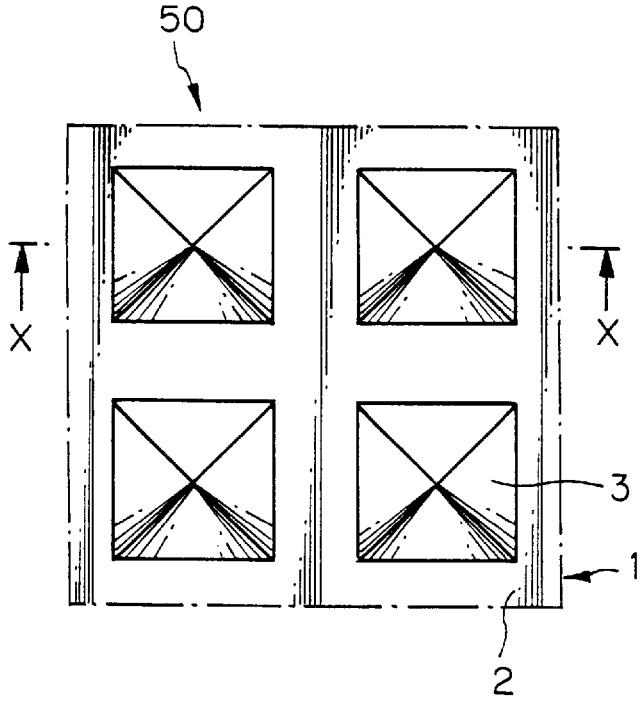
FIG. 2A is a plan view of a dresser according to the present invention and FIG. 2B is a sectional view taken along the line X—X in FIG. 2A.
Figure 2B:
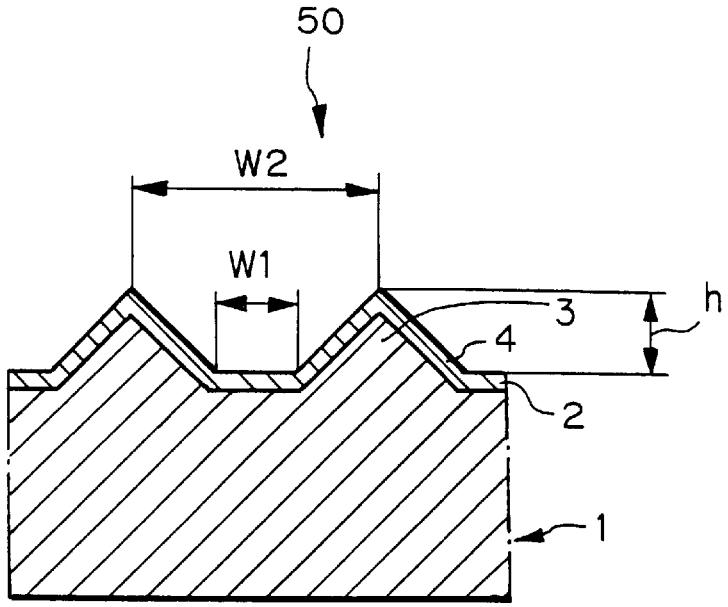
Figure 5:
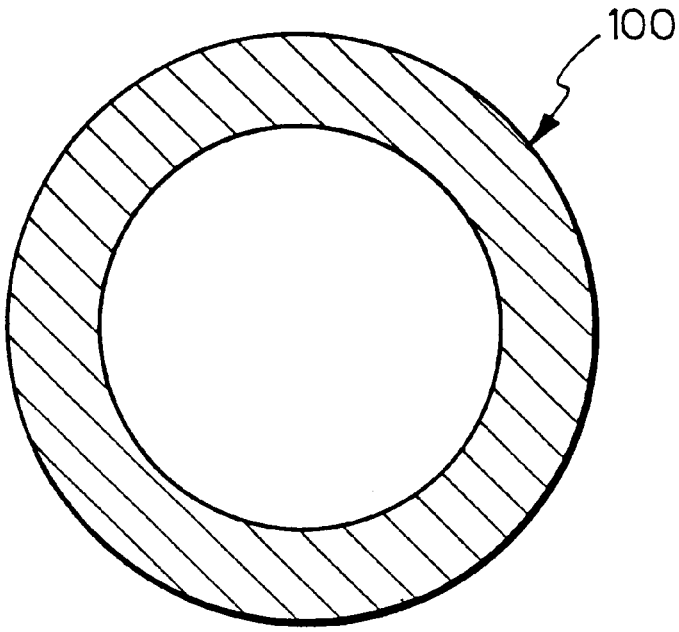
FIG. 5 is a view showing a conventional dresser.
Figure 7:
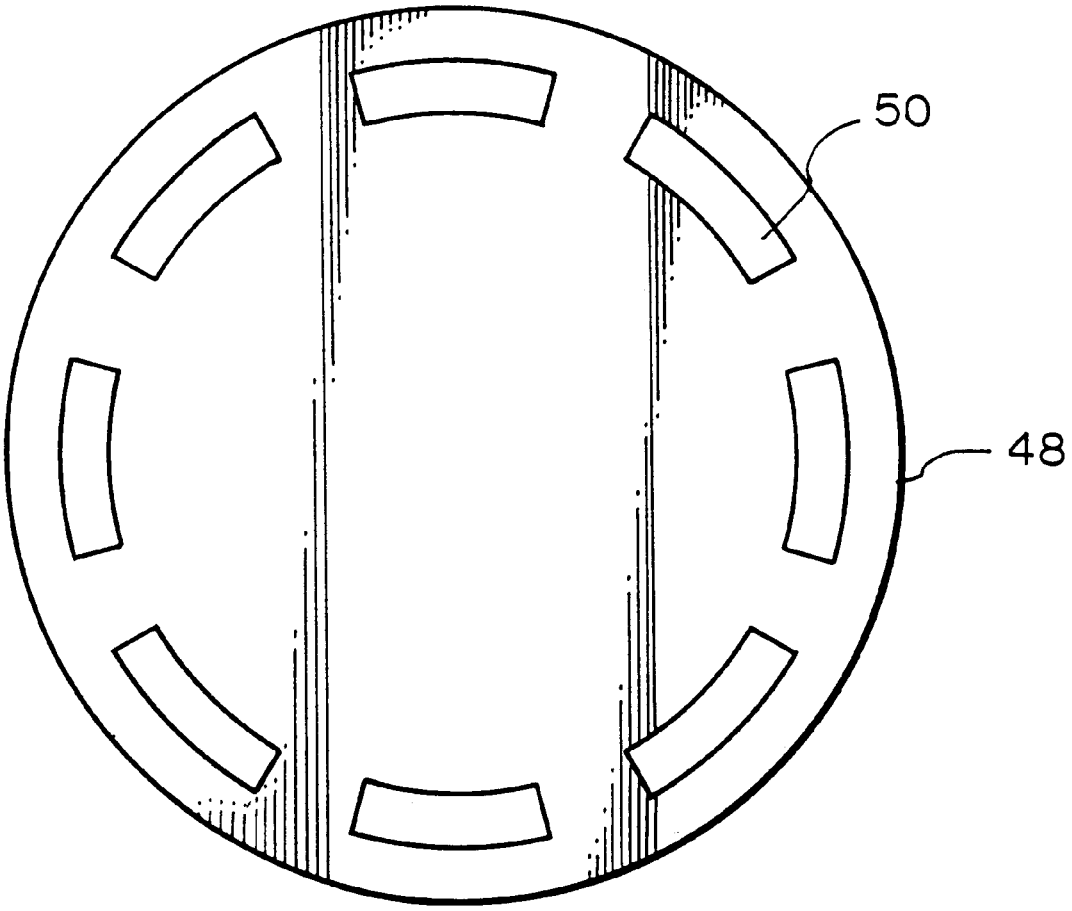
FIG. 7 is plan view of a dresser according to another embodiment of the present invention.

FIG. 2A is a partial enlarged view of the dresser 50 for dressing the polishing cloth, and FIG. 2B is a sectional view of the dresser. The dresser 50 is obtained by forming a number of pyramid-shaped (quadrangular pyramid-shaped) projections 3 on a surface of a metallic substrate 1 by machining and by covering the surface of the metallic substrate 1 on which the projections 3 are formed by a wear-resistant hard film 4. The configuration of the projection is not limited to the pyramid, but, for example, cone-shaped, trigonal pyramid-shaped or polygonal pyramid-shaped spire projections may be used. Incidentally, regarding the dresser 50 according to the present invention, as shown in FIG. 7, a plurality (eight in the illustrated embodiment) of arcuate dressers 50 are equidistantly disposed on the lower surface of the dressing member 48 along a circumferential direction. The configuration of the dresser is not limited to that shown in FIG. 7, but, a disc-like pellet dresser or a ring-shaped dresser as shown in FIG. 5 may be used.

The wear-resistant hard film 4 is preferably formed from transition metal group nitride such as titanium nitride, nitride group ceramics such as boron nitride or carbon nitride, carbide group ceramics such as chrome carbide or boron carbide, or diamond-like carbon. In order to improve the features of the film regarding anti-corrosion and wear-resistance, a composite ceramic film obtained by combining two or more above-mentioned ceramics can be used. For example, titanium/aluminum composite nitride group ceramics may be used. The composite ceramic film may be a laminated ceramic film, a fiber synthetic film or a ceramic films having three or more elements, for example. When the durability is required, it is desirable that Vickers hardness of the ceramic film is selected to 2000 kg/mm$^2$ or more. Further, the surface of the metallic substrate may be reformed by a nitride coating or a carbide coating.

The ceramic film is preferably formed by chemical deposition, physical deposition, spraying, wet plating or melting plating. Since the strong adhering force of the ceramic film to the metallic substrate 1 is desired in view of the durability, melting plating or the spraying is particularly desirable.

In the dresser for dressing the polishing cloth used in the polishing apparatus for polishing the semiconductor wafer, flatness of the surface of the dresser is required. In order to prevent thermal deformation and thermal degeneration of the metallic substrate 1, it is desirable that a forming temperature of the wear-resistant hard film 4 is reduced to a minimum. A film forming method utilizing an ion beam technique such as spattering, ion plating, ion implantation, plasma source ion implantation (PSII) or ion injection and vacuum deposition (dynamic mixing) is preferable as the ceramic film forming method since the ceramic film forming temperature is relatively low.

Particularly, the ion plating, plasma source ion implantation (PSII), and the dynamic mixing (in which vacuum deposition and ion beam irradiation are effected simultaneously) are preferable for the method for manufacturing the dresser for dressing the polishing cloth used in the polishing apparatus for polishing the semiconductor wafer, since the treating temperature is relatively low and the adhering force of the wear-resistant hard film 4 to the metallic substrate 1 is strong.

The metallic substrate 1 may be formed from austenite group stainless steel such as SUS 304, deposition hardened stainless steel, martensite group stainless steel or two-phase stainless steel. In the present invention, the material of the metallic substrate is not limited to the aforementioned stainless steels. For example, when high anti-corrosion is required, the metallic substrate may be formed from higher metallic material such as titanium alloy.

When a thin titanium nitride film is formed on the surface 2 of the metallic substrate 1 on which the projections 3 are formed by the dynamic mixing in which the vacuum deposition of titanium and irradiation of ion beams (mainly including nitrogen ions) are effected simultaneously onto the surface 2, since the titanium nitride film has high adhering ability to the metallic substrate 1 and good wear-resistance as will be described later, a polishing cloth dressing dresser having good durability can be obtained.

The titanium nitride hard film formed by the dynamic mixing has excellent hardness, that is, Vickers hardness of film itself of 2500 kg/mm2 (2500 HV, unit of Vickers hardness HV is equivalent to kg/mm2) or more, and strong adhering force to the material of the substrate (shearing stress of 2.8 GPa or more by a scratch test).

Figure 3:
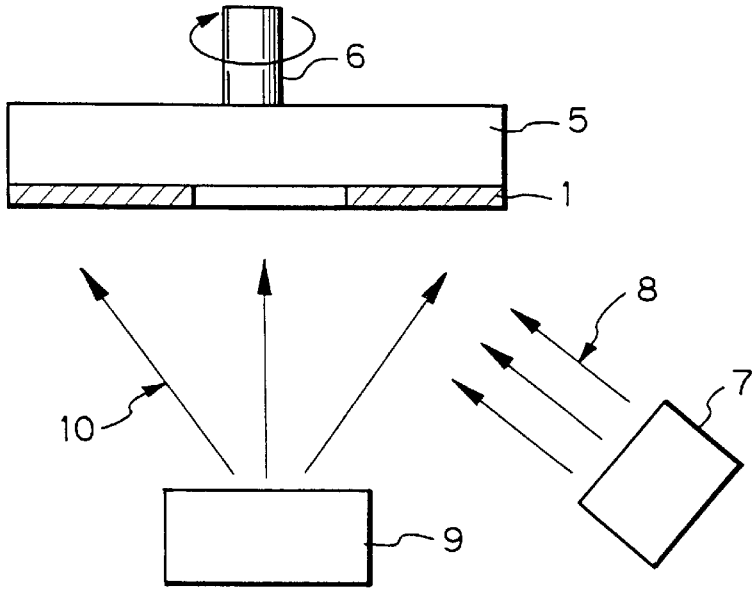
FIG. 3 is a view for explaining a dynamic mixing method.

Now, a concrete example for forming the wear-resistant hard film 4 on the surface 2 of the metallic substrate 1 on which the projections 3 are formed will be described. FIG. 3 is a view for explaining a method for forming a thin titanium nitride film by the dynamic mixing. The metallic substrate 1 for the dresser (as shown in FIG. 2) having the surface 2 on which the projections 3 are formed is mounted on a copper holder 5 which is secured to a rotary shaft 6 and cooled, in such a manner that the surface 2 on which the projections 3 are formed is directed outwardly.

A vapor source 9 and an ion source 7 are disposed in an opposed relation to the metallic substrate 1. Titanium vapor 10 is emitted from the vapor source 9 toward the metallic substrate 1 and ion beams (mainly including nitrogen ions) 8 is irradiated from the ion source 7 toward the metallic substrate 1, and, at the same time, by vaporizing the titanium by electron beams, the thin titanium nitride film is formed on the surface of the metallic substrate 1. The thin titanium nitride film formed in this way has Vickers hardness of 2500 kg/mm2 or more and adhering force (between the film and the metallic substrate) of 2.8 GPa or more (shearing force by scratch test). Incidentally, a thickness of the thin titanium nitride film formed in the illustrated embodiment is 5 $\mu$m. However, the thickness is not limited to such a value.

In an arrangement the same as that shown in FIG. 3, by emitting carbon vapor under vacuum from the vapor source 9 (vacuum deposition of carbon) toward the metallic substrate 1 and, at the same time, by irradiating ion beams 8 (mainly including nitrogen ions) from the ion source 7 toward the metallic substrate 1, a diamond-like carbon film may be formed on the surface of the metallic substrate 1. The diamond-like carbon film formed in this way has a thickness of 5 $\mu$m, Vickers hardness of 2500 kg/mm$^2$ and adhering force (between the film and the metallic substrate) of 2.8 GPa or more (shearing force by scratch test).

A Table 1 shows comparison results (of the polished surfaces of the semiconductor wafers) when the semiconductor wafers are polished by using the polishing surfaces dressed by the conventional dresser and the dressers according to embodiments of the present invention.

Figure 6:
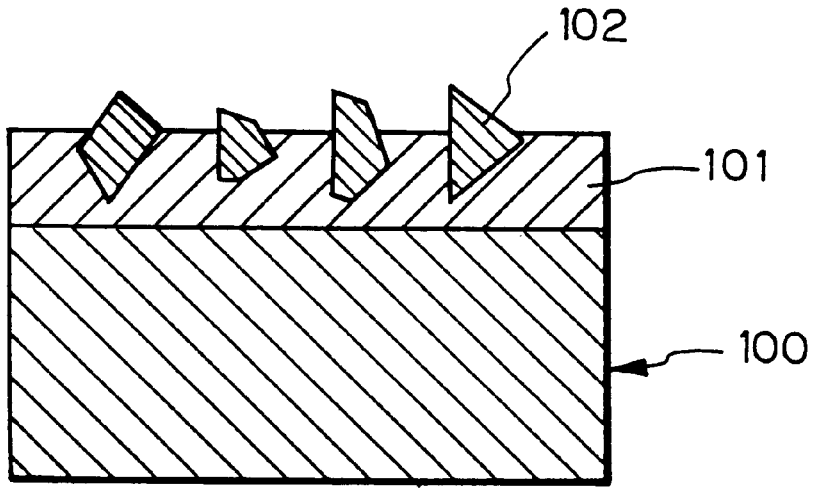
FIG. 6 is a sectional view of the conventional dresser.

In the Table 1, the surface of the dresser in the conventional technique is constituted by diamond abrasive coating in which diamond particles 102 are electro plated as shown in FIG. 6, the surface of the dresser in the embodiment 1 is constituted by the titanium nitride hard film formed by the dynamic mixing (film hardness=3500 HV), the surface of the dresser in the embodiment 2 is constituted by the diamond-like carbon film formed by the dynamic mixing (film hardness=2500 HV), and the surface of the dresser in the embodiment 3 is constituted by the titanium nitride hard film formed by the dynamic mixing (film hardness=3500 HV).

Further, in the embodiment 1, a peak-to-peak distance W2 (refer to FIG. 2B) between the projections 3 is selected to 0.3 mm, a width W1 (refer to FIG. 2B) of a groove (between the projections) is selected to 0 mm and a height h (refer to FIG. 2B) of the projection is selected to 0.15 mm; in the embodiment 2, W2=0.3 mm, W1=0 mm and h=0.15 mm; and, in the embodiment 3, W2=0.6 mm, W1 =0.3 mm and h=0.15 mm.

In the conventional technique, when the semiconductor wafers were polished at a polishing speed of 85 nm/min, it was found that the polished surface of the wafer is deeply scratched at a rate of about 1/200 (one wafer per 200 wafers); to the contrary, in the embodiments 1 to 3, it was found that there were no scratches on the polished surfaces of the wafers. Incidentally, the polishing speed in the embodiment 1 was 75 nm/min, the polishing speed in the embodiment 2 was 80 nm/min, and the polishing speed in the embodiment 3 was 103 nm/min. As is apparent from the Table 1, the dressers according to the embodiments 1 to 3 are considerably excellent in comparison with the dresser in the conventional technique.

Figure 4:
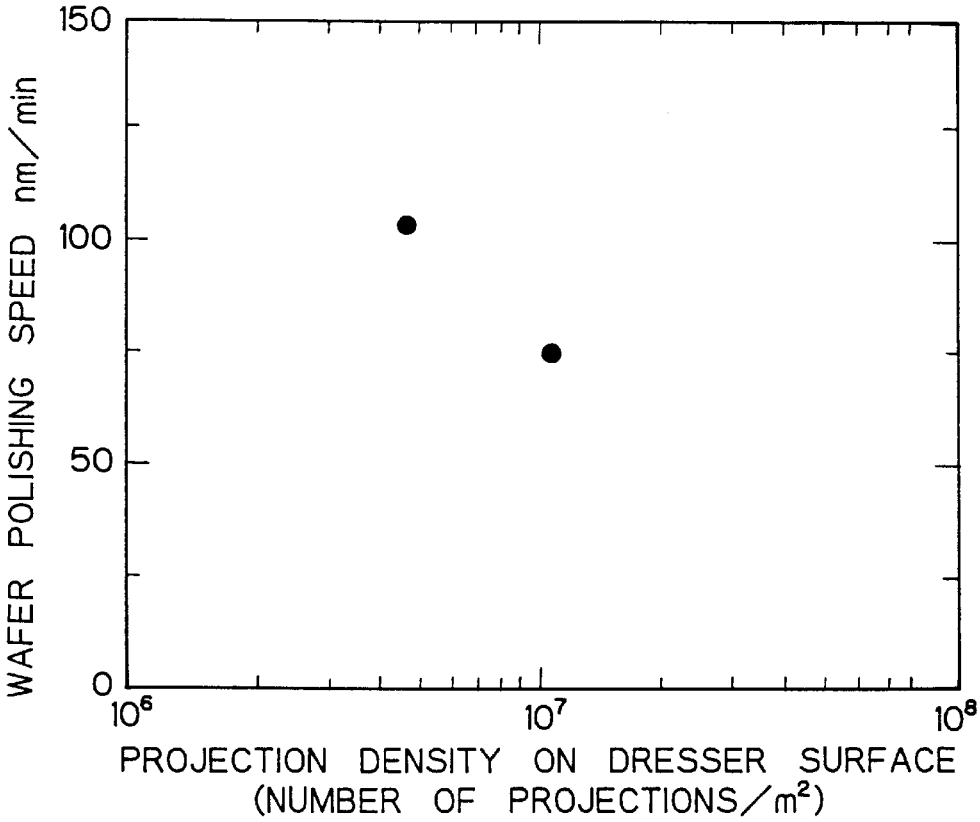
FIG. 4 is a graph showing a relation between density of projections formed on a surface of the dresser and a wafer polishing speed.

FIG. 4 is a graph showing a relation between density (number/m$^2$) of projections formed on the surface of the metallic substrate 1 of the dresser according to the illustrated embodiment and a wafer polishing speed (nm/min). As shown in FIG. 4, the wafer polishing speed depends upon the density of the projections 3. If the density of the projections 3 is too great, waste matters generated by the dressing process are trapped between the projections 3. Accordingly, an adequate dressing effect of the polishing surface is not obtained with the result that the wafer polishing speed is decreased.

As mentioned above, according to the present invention, there is provided an improved dresser (for the polishing surface) in which the polished surface of the work object such as the semiconductor wafer is not scratched when the work object is polished, and a method for manufacturing such an improved dresser.

TABLE 1

Polishing test results

| | Dresser | | | Wafer *1 | |
|---|---|---|---|---|---|
| | Shape of surface projection | Surface coating | Film hardness (HV) | Surface condition | Polishing speed (nm/min) |
| Conventional technique | — | Diamond abrasive coating | | Scratch (sometimes) *2 | 85 |
| Embodiment 1 | W2 = 0.3 mm<br>W1 = 0 mm<br>h = 0.15 mm | DM-TiN hard film | 3500 | Good | 75 |
| Embodiment 2 | W2 = 0.3 mm<br>W1 = 0 mm<br>h = 0.15 mm | DM-DLC film | 2500 | Good | 80 |
| Embodiment 3 | W2 = 0.6 m<br>W1 = 0.3 mm<br>h = 0.15 mm | DM-TiN hard film | 3500 | Good | 103 |

*1 Wafer polishing conditions: Surface pressure is 500 gf/cm$^2$, Revolutions of turntable is 25 rpm, Polishing revolutions is 35 rpm.
*2 Frequency of scratch is about one sheet of wafer per 200 sheets.

What is claimed is:

1. A dresser for dressing a polishing surface of a polishing apparatus used to polish a surface of a semiconductor wafer, said dresser comprising:

a substrate having a surface which has a plurality of spired projections formed thereon; and a wear-resistant hard film covering said surface of said substrate and said spired projections formed on said surface of said substrate, said wear-resistant hard film being formed on said surface of said substrate by one of plasma source ion implantation and dynamic mixing.

2. The dresser of claim 1, wherein said process is dynamic mixing and said dynamic mixing comprises vacuum deposition and ion beam radiation effected simultaneously.

3. The dresser of claim 1, wherein said wear-resistant hard film is formed from one of a transition metal group nitride film, a nitride group ceramic film, a carbide group ceramic film, an oxide group ceramic film, and a diamond-like carbon film.

4. The dresser of claim 3, wherein said transition metal group nitride film is made of titanium nitride.

5. The dresser of claim 1, wherein said wear-resistant hard film is formed from one of a composite ceramic film, a nitride film, and a carbide film.

6. The dresser of claim 5, wherein said nitride film is made of titanium nitride.

7. A polishing apparatus comprising:

a polishing surface on a turntable;

a top ring adapted to hold and press a work object against said polishing surface; and a dressing mechanism for dressing said polishing surface, said dressing mechanism including a dressing member adapted to hold and press a surface of a dresser against said polishing surface, wherein said dresser comprises a substrate having a surface which has a plurality of spired projections formed thereon, and a wear-resistant hard film covering said surface of said substrate and said spired projections formed on said surface of said substrate, said wear-resistant hard film being formed on said surface of said substrate by one of plasma source ion implantation and dynamic mixing.

8. The polishing apparatus of claim 7, wherein said process is dynamic mixing and said dynamic mixing comprises vacuum deposition and ion beam radiation effected simultaneously.

9. The polishing apparatus of claim 7, wherein said wear-resistant hard film is formed from one of a transition metal group nitride film, a nitride group ceramic film, a carbide group ceramic film, an oxide group ceramic film, and a diamond-like carbon film.

10. The polishing apparatus of claim 9, wherein said transition metal group nitride film is made of titanium nitride.

11. The polishing apparatus of claim 7, wherein said wear-resistant hard film is formed from one of a composite ceramic film, a nitride film, and a carbide film.

12. The polishing apparatus of claim 11, wherein said nitride film is made oftitanium nitride.

13. A dresser for dressing a polishing surface of a polishing apparatus used to polish a surface of a semiconductor wafer, said dresser comprising:

a metallic substrate having a surface which has a plurality of spired projections formed thereon; and a wear-resistant hard film covering said surface of said metallic substrate and said spired projections formed on said surface of said metallic substrate.

14. The dresser of claim 13, wherein said spired projections are mechanically formed.

15. The dresser of claim 13, wherein said metallic substrate comprises a metal selected from the group consisting of austenite group stainless steel, hardened stainless steel, martensite group stainless steel, two-phase stainless steel and titanium alloy.

16. The dresser of claim 13, wherein said wear-resistant hard film is formed from one of a transition metal group nitride film, a nitride group ceramic film, a carbide group ceramic film, an oxide group ceramic film, and a diamond-like carbon film.

17. The dresser of claim 16, wherein said transition metal group nitride film is made of titanium nitride.

18. The dresser of claim 13, wherein said wear-resistant hard film is formed from one of a composite ceramic film, a nitride film, and a carbide film.

19. The dresser of claim 18, wherein said nitride film is made of titanium nitride.

20. A polishing apparatus comprising:

a polishing surface on a turntable;

a top ring adapted to hold and press a work object against said polishing surface; and a dressing mechanism for dressing said polishing surface, said dressing mechanism including a dressing member adapted to hold and press a surface of a dresser against said polishing surface, wherein said dresser comprises:

a metallic substrate having a surface which has a plurality of spired projections formed thereon, and a wear-resistant hard film covering said surface of said metallic substrate and said spired projections formed on said surface of said metallic substrate.

21. The polishing apparatus of claim 20, wherein said spired projections are mechanically formed.

22. The polishing apparatus of claim 20, wherein said metallic substrate comprises a metal selected from the group consisting of austenite group stainless steel, hardened stainless steel, martensite group stainless steel, two-phase stainless steel and titanium alloy.

23. The polishing apparatus of claim 20, wherein said wear-resistant hard film is formed from one a transition metal group nitride film, a nitride group ceramic film, a carbide group ceramic film, an oxide group ceramic film, and a diamond-like carbon film.

24. The polishing apparatus of claim 23, wherein the transition metal group nitride film is made of titanium nitride.

25. The polishing apparatus of claim 20, wherein said wear-resistant hard film is formed from one of a composite ceramic film, a nitride film, and a carbide film.

26. The polishing apparatus of claim 20, wherein said nitride film is made of titanium nitride.

* * * * *

UNITED STATES PATENT AND TRADEMARK OFFICE

CERTIFICATE OF CORRECTION

PATENT NO. : 6,432,257 B1
DATED : August 13, 2002
INVENTOR(S) : Hiroshi Nagasaka et al.

It is certified that error appears in the above-identified patent and that said Letters Patent is hereby corrected as shown below:

Title page,
Item [73], Assignee, after (JP), insert the following:
-- Kabushiki Kaisha Toshiba, Kanagawa-Ken, Japan --

Signed and Sealed this

Twelfth Day of November, 2002

*Attest:*

*Attesting Officer*

JAMES E. ROGAN
*Director of the United States Patent and Trademark Office*